United States Patent [19]

D'Entremont

[11] Patent Number: 4,476,452

[45] Date of Patent: Oct. 9, 1984

[54] MOTOR PROTECTOR

[75] Inventor: John R. D'Entremont, Foxboro, Mass.

[73] Assignee: Texas Instruments Incorporated, Dallas, Tex.

[21] Appl. No.: 424,826

[22] Filed: Sep. 27, 1982

[51] Int. Cl.[3] ..... H01H 61/02

[52] U.S. Cl. ..... 337/102; 337/107

[58] Field of Search ..... 337/102, 107, 105, 103

[56] References Cited

U.S. PATENT DOCUMENTS 3,095,486 6/1963 Perry ..... 337/109

4,399,423 8/1983 Nield ..... 337/102

*Primary Examiner*—Harold Broome

*Attorney, Agent, or Firm*—John A. Haug; James P. McAndrews; Melvin Sharp

[57] ABSTRACT

A miniature motor protector particularly suitable for low current applications has a generally rectangular parallelepiped configured metallic housing open at the top and has a bottom wall and side walls extending upwardly therefrom, the side walls having a flange forming a ledge portion at their free ends extending around all four sides. An electrically insulative gasket is disposed on the ledge with a lid having two discrete portions spaced from one another placed on top of the gasket. Extensions of the flange portions are bent over the gasket and lid to clampingly engage them. A heater element having two ends extends between the two portions of the lid with one end electrically and mechanically attached to one portion and the other end electrically and mechanically attached to the other portion. A first switch element is mounted on one of the lid portions and a second switch element is mounted on the bottom wall of the housing with one of the switch elements including a cantilever mounted snap-acting thermostatic member adapted to move into and out of engagement with the other of the switch elements upon selected thermal conditions of the thermostatic member.

8 Claims, 6 Drawing Figures

MOTOR PROTECTOR

The present invention relates generally to devices used to protect electrical equipment such as motors from fault conditions and more particularly protectors to be used with low current, fractional horsepower motors.

Over the years there has been a trend in making electrical equipment to continually reduce the size as well as the cost of such equipment. Cost reductions are generally effected by using less expensive materials and components. This has had the beneficial effect of increasing the market for such equipment by minimizing price escalation and in many cases by actually decreasing prices. Following this trend there has been a need to produce efficient, effective, and reliable devices which are not only less expensive and smaller in size to protect such equipment but also more sensitive than prior art devices since the normal safety margins designed into the equipment to be protected which allow some overheating without concomitant damage to the equipment as a rule has also been pared in the cost reduction cycle.

In a typical automobile, for example, there may be many small, low current motors to perform such functions as automatic door locking, windshield wiping, antenna movement, movement of headlight covers and so on. These are generally very small, low current devices which require miniature motor protectors which will reliably disconnect the motors from the power source in the event of a fault condition before the motor is damaged as a result of overheating. Such overheating can occur within a matter of seconds; as in the case of movable members exposed to the environment outside the car when they are prevented from moving due to ice blockage or the like resulting in a locked rotor condition of the motor. As a result it is a requirement of suitable protectors that they open or disconnect the circuit upon drawing current in excess of a selected value within a very consistent narrow range of times. For example protectors for one type of small automotive motor should disconnect the motor from the power source within a time period of between 3 and 6 seconds (referred to as "on" time) upon the occurrence of a locked rotor condition to avoid damage to the motor which could occur in as little as 10 seconds or less.

Miniature motor protectors comprising a small housing in which is disposed an electrical switch including a small current carrying thermostatic disc adapted upon the occurrence of certain thermal conditions to snap into and out of engagement with a stationary contact to respectively close and open an electrical circuit are available which are very reliable and inexpensive however in order to make them quickly responsive to very small current levels, it is necessary to provide a supplemental heater mounted in heat transfer relation with the disc. An example of this type of protector is described and claimed in U.S. Pat. No. 3,622,930 assigned to the assignee of the present invention. In this case a heater is mounted inside the housing of the protector which in turn mounts the disc in good heat transfer relationship therewith. However one of the problems associated with this type of device is that the position of the fixed end of the disc tends to change slightly thereby changing the calibration of the disc. In devices of the type described a shift of as little as 0.002 inch can cause the device to fall completely out of the desired range of calibration. Since the heater element forms a structural component in determining the location of the disc relief of inherent stresses and the like in the heater element upon heating can cause slight warpage with the result that the location of the disc mount can be concomitantly changed. Other examples may be found in U.S. Pat. Nos. 4,136,323 and 4,224,591. In these patents heaters are disposed externally of the housing of the protector. These provide a desirable relatively long off time, i.e. the time required for the disc to cool off sufficiently to snap back to a circuit engaging position, since the housing acts as a heatsink and supplies heat to the disc even after the disc has snapped to a circuit disengaging position. This relatively long off time which may be on the order of $1\frac{1}{2}$ to 2 minutes is generally desirable to ensure that the motor being protected has had a change to cool off before any damage occurs. However, due to the fact that the heater is mounted externally of the can in a location relatively remote from the disc the "on" times tends to be longer than desired for many applications. Additionally, due to the remoteness of the heater from the disc the time from device to device is not as consistent as desired. In other words, the spread of range of "on" time for a group of devices instead of being in the 3–6 second range may have a significantly wider band.

In copending application Ser. No. 363,187, filed Mar. 3, 1982, now U.S. Pat. No. 4,399,423, and assigned to the assignee of the instant invention a similar miniature motor protector is described and claimed in which a heater is fashioned from a plate-like element having a first portion mounting a portion of the switch, either the stationary contact or the thermostatic disc, a second portion formed into a selected heater configuration such as a serpentine shape having one or more loops extending from ledges formed on opposite sides of the housing and a third mounting portion adapted to be supported by a ledge formed on all four sides of a parallelepipedly shaped housing. An electrically insulative gasket is disposed between the plate-like element and the housing ledge to electrically separate the two. A window formed in the gasket receives either the stationary contact or the mount for the thermostatic member. Since the structural relationship of the switch portions to one another are not dependent on the heater in the protector having the three portion plate-like element such calibration shifts are obviated and therefor this protector provides selected on-off times which are reliable and consistent however the integrally formed element has certain characteristics which tend to limit its applicability. For example, heater materials such as various nickel alloys are significantly more expensive than conventional cold roll steel or the like which would otherwise be used in fabricating the cover for the protector so that the three portion element may be considerably more expensive than the separate heater-cover combinations of the prior art. The integrally formed element also results in using the particular heater material as the termination point for external connections rather than conventional housing material. This may require special handling techniques and therefor increase the possibility of improper handling by manufacturers when applying and connecting the protector to a motor. Another limitation on the applications with which the three portion integral element can be used is the fact that the range of resistance which can be used with the element is more limited than if a separate heater were employed.

Briefly a protector made in accordance with the invention comprises a housing having an open end with a ledge formed around the open end and a gasket and lid received on and clamped to the housing. A heat responsive electrical switch is disposed in the housing and is adapted to electrically connect and disconnect the housing and lid upon the occurrence of selected thermal conditions. The lid comprises two discrete, spaced portions, one portion having an elongated part to serve as a terminal and the other portion mounting a portion of the switch. A heater, preferably in the form of a coil is electrically and mechanically connected, as by conventional welding techniques, between the two portions of the lid. The longitudinal axis of the coil is preferably parallel or perpendicular to the longitudinal axis of the housing along which the lid portions are spaced. A separate electrically insulative housing is shown having a cavity adapted to receive the protector and is provided with electrical sockets connectable to the terminals of the protector.

It is therefore an object of the present invention to provide a miniature, low cost protector particularly suitable for low current applications, a protector which has reliable, consistent, short "on" times yet one which also has relatively long "off" times. Another object is to provide a protector which can be made having selected "on" times from a wide range and can be used with existing motor starting relays, either electromechanical or solid state (positive temperature coefficient resistor type) and can even be packaged therewith in a common housing if so desired.

Other objects, advantages, and details of the novel and improved electrical circuit protector device of this invention appear in the following detailed description referring to the drawings in which.

Figure 1:
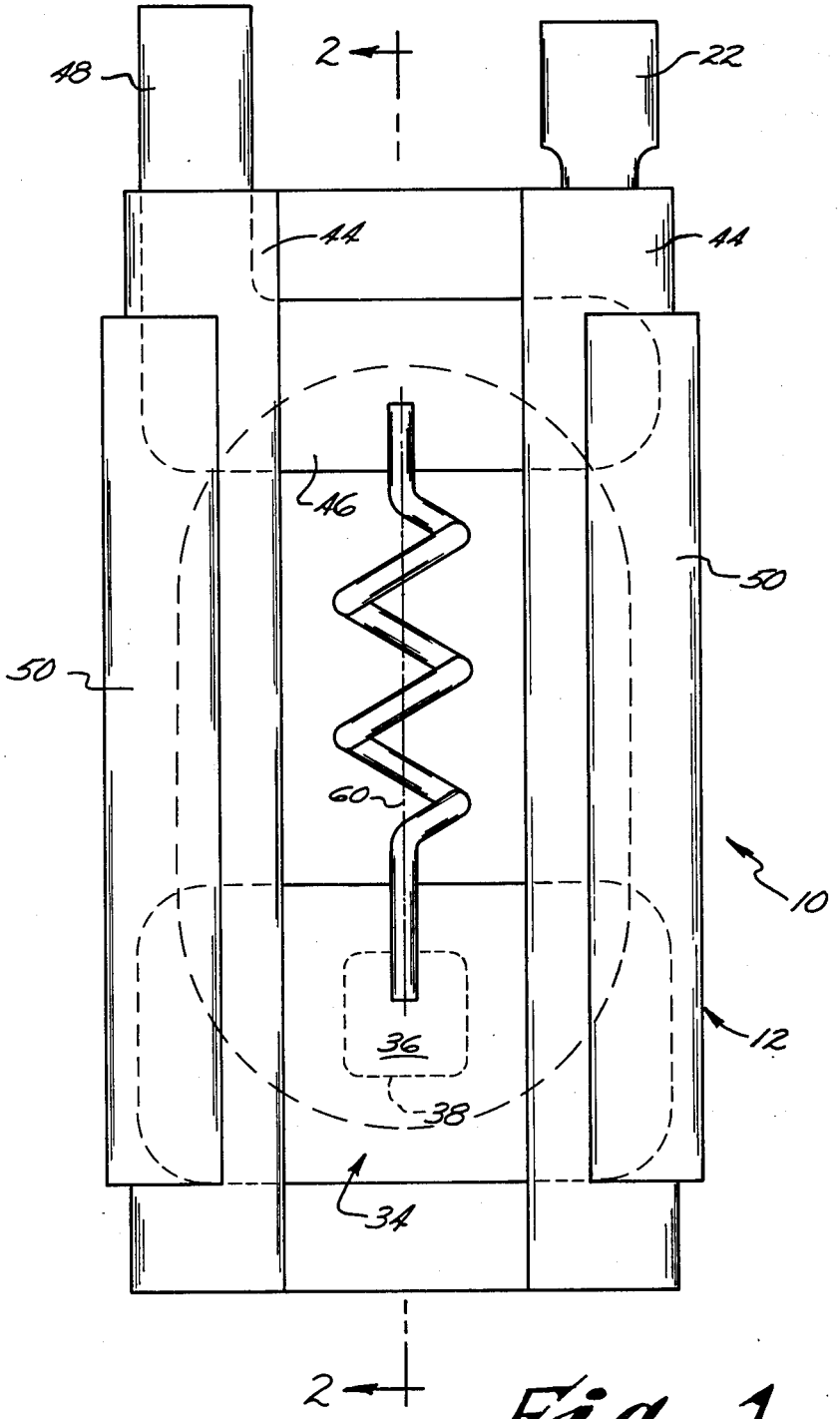
FIG. 1 is a top plan view of the protector of this invention.
Figure 2:
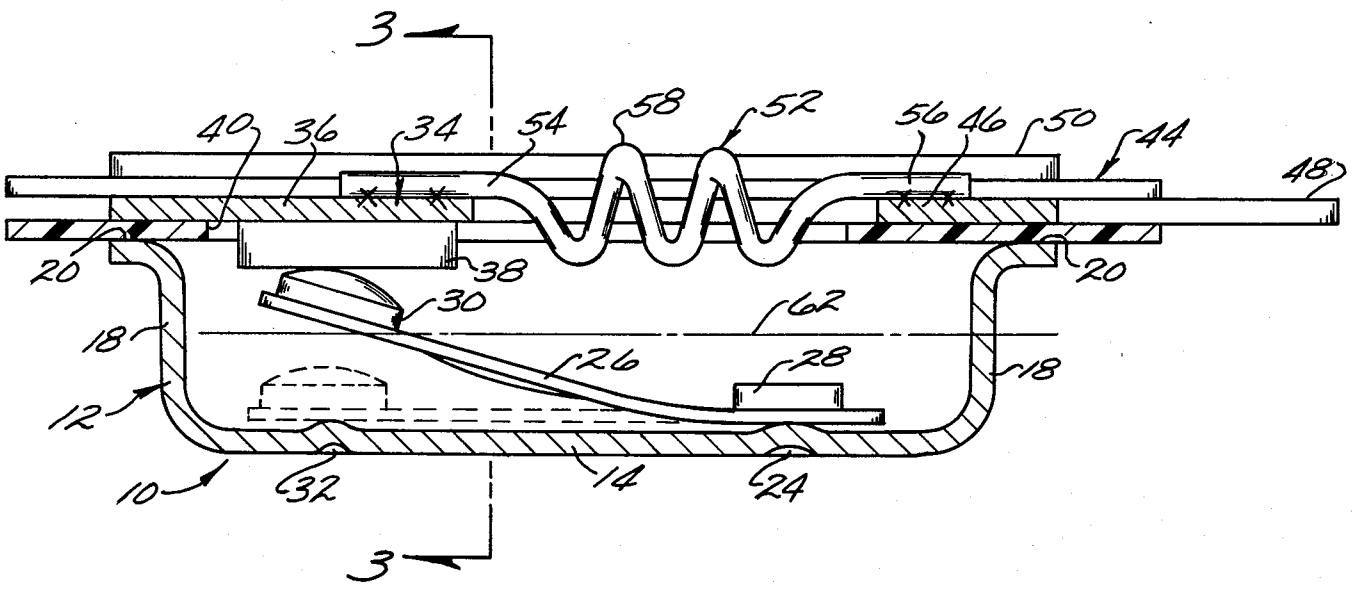
FIG. 2 is a cross sectional view taken along line 2—2 of FIG. 1.
Figure 3:
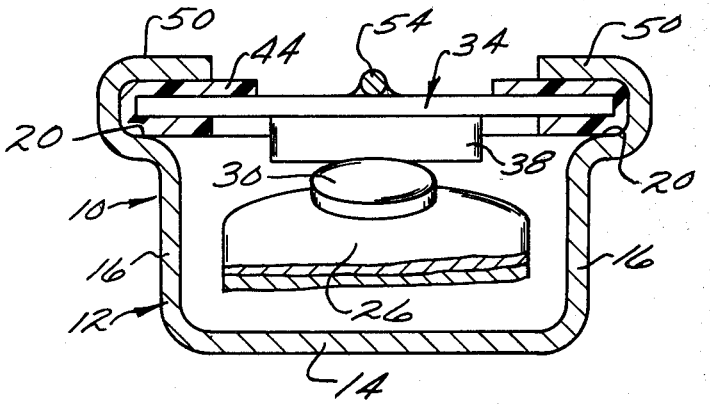
FIG. 3 is a cross sectional view taken along line 3—3 of FIG. 2.

Referring to the drawings, numeral 10 in FIGS. 1-3 indicates the protector made in accordance with the invention and which is shown to include a generally parallelepiped, open ended, electrically and thermally conductive metal can or housing 12 having a bottom 14 and depending opposed side walls 16 and end walls 18. Walls 16 and 18 have a free end formed into a ledge portion 20 extending around the open end of the housing. Preferably a portion 22 of the ledge extends from the housing to serve as an integral terminal. Side walls 16 are also preferably formed with portions 50 extending from ledge 20 to facilitate attachment of a gasket 44 and lid 34 to be described below. Gasket 44 is formed of any suitable electrically insulative material capable of withstanding elevated temperatures such as polyethylene terephthalate. A window 40 is cut out of gasket 44 to permit a stationary contact mounted on the lid of the device to be exposed to the interior of the housing. Indentation 24 may be formed in the housing bottom to provide a weld projection inside the housing bottom, preferably using a conventional weld button 28 as shown in FIG. 2 so that the bimetal member extends in cantilever relation to the housing bottom to support a movable electrical contact 30 of conventional contact material at the distal free end of the bimetal member. The bimetal member 26 preferably has a dished portion intermediate its ends so that the member is adapted to move with snap action from a first position shown in solid lines in FIG. 2 to a second position shown in broken lines when the bimetal is heated to a selected actuating temperature. The bimetal member is also adapted to move with snap action back to said first position when the bimetal member subsequently cools to a relatively lower, reset temperature. Preferably an indentation 32 in the housing bottom provides a stop for limiting movement of the bimetal member as it snaps to the second broken line position. Alternatively of course other thermally responsive switch means of a conventional type may be incorporated within the protector for electrically connecting and disconnecting a circuit on the occurrence of an overload current or overtemperature condition in the protector.

Lid 34 formed of any suitable electrically conductive material, such as cold roll steel, comprises two discrete portions 36, 46 received and supported on ledge 20 of housing 12. Portions 36, 46 are spaced from one another along the longitudinal axis of housing 12. First portion 36 mounts thereon a portion of the switch mechanism. As seen in the drawings, stationary contact 38 is attached to lid portion 36 however it is within the purview of the invention to affix the stationary contacts to bottom wall 14 and mount disc 26 on lid portion 36 if so desired. Contact 38 is attached to lid portion 36 in any conventional manner and is adapted to pass through a window 40 formed in gasket 44 to permit electrical connection of movable and stationary contacts 30, 38. Second lid portion 46 is formed with an elongated arm 48 which serves as a terminal for external electrical connection.

A heater element 52 formed of any suitable electrical resistance material, such as nichrome or other nickel alloys, has a first end 54 electrically and mechanically attached, as by welding, to first lid portion 36 and a second end 56 electrically and mechanically attached, as by welding, to second lid portion 46. The portion 58 intermediate the ends is preferably formed into a coil configuration which extends between the two lid portions and is closely adjacent heat responsive disc 26. Coil 58 which has a longitudinal axis 60 (FIG. 1) is disposed relative to longitudinal axis 62 of housing 12 (FIG. 2) in such a way that the longitudinal axes are parallel to one another.

Figure 5:
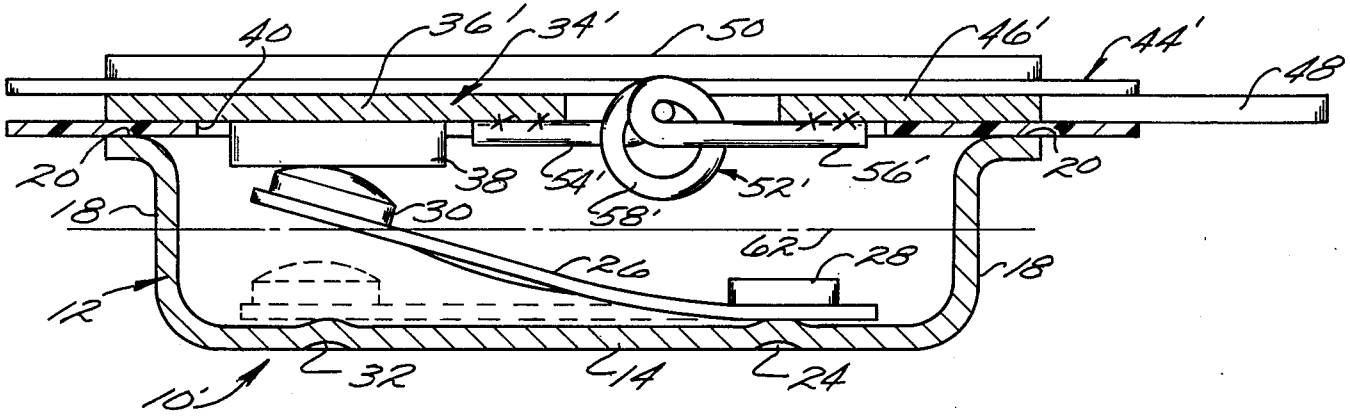
FIG. 5 is a cross sectional view similar to FIG. 2 of an alternative embodiment of the invention.
Figure 6:
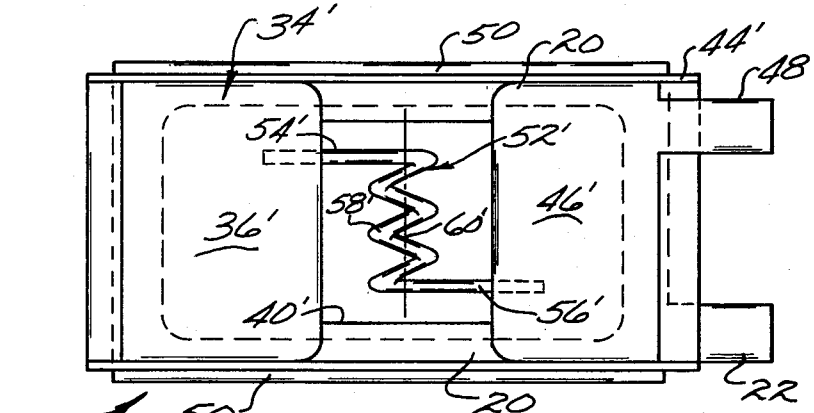
FIG. 6 is a cross sectional view similar to FIG. 3 of the FIG. 5 embodiment.

Although heater element 52 is shown in the drawings attached to the outer surface of lid 34 it will be appreciated that if it is desired to obtain closer spacing between heater 52 and disc 26 the heater could be attached to the inner or lower surface of lid 34 as shown in the embodiment of FIGS. 5 and 6 discussed below.

Figure 4:
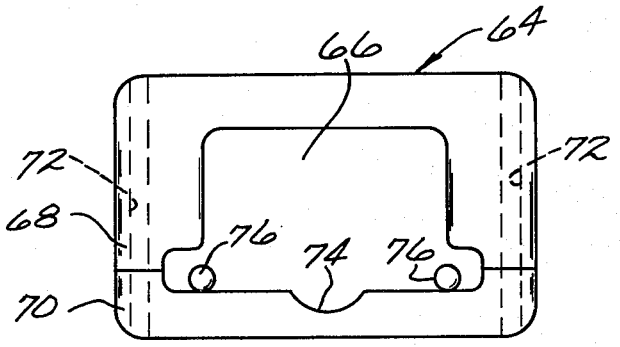
FIG. 4 is an end view of a housing in which the protector of FIGS. 1-3 may be disposed.

FIG. 4 depicts a housing formed of electrically and thermally insulative material, such as a conventional phenolic and formed with a cavity 66 adapted to receive therein a protector 10. Housing 64 may be formed of first and second parts 68, 70 secured together by conventional fasteners (not shown) inserted through bores 72. Lower part 70 is provided with a recessed section 74 adapted to accommodate coil 52. Pin connectors 76 are mounted in housing 64 and are connectable to terminals 22, 48 respectively. Thus protector 10, mounted in housing 64 protected from the environment, can be conveniently mounted on a motor to be protected merely by pushing the connectors 76 onto mating pins provided on the motor.

FIGS. 5 and 6 show an alternative embodiment in which heater element 52' has a coil section 58' having a longitudinal axis 60' which extends in a direction generally perpendicular to the longitudinal axis 62 of housing 12. By disposing the coil in this fashion the separation between portions 36' and 46' of lid 34' can be decreased. End 54' of heater 52' is suitably electrically and mechanically attached to portion 36' as by welding, as is end 56' attached to portion 46'. In the FIGS. 5, 6 embodiment it will be noted that ends 54', 56' are attached to the bottom surface of lid 34' thereby bringing the heat source closer to the thermal element 26 as well as to decrease the overall height of the protector. In some cases, depending on the specific dimensions of the heater element employed, the heater may not extend above clamp portions 50 which would facilitate placing of the protector within a sleeve of electrically insulative material (not shown) without having to be concerned about the proximity of the sleeve to the heater.

On the other hand if particular heat requirements were such that a larger coil were needed for the heater element it can easily be mounted to the outer surface of lid 34' thereby providing more height to accommodate the coil.

It will be noted that FIG. 6 shows protector 10' prior to the bending of portions 50 to clampingly attach lid 34' to the housing. The particular configuration of window 40' of gasket 44' is selected to provide room both for heater 58' and stationary contact 38.

The above protectors are particularly advantageous for small fractional horsepower motors in those applications where cost reduction as well as the need for predictable, precise "on" to "off" time ratios are critical factors. The protector of the instant invention has great flexibility in that a wide range of rating selections is available due to the heater-lid configuration. Since the lid portions can be constructed out of conventional cold roll steel they can blanked at a minimum of cost. The separation between the lid portions can vary widely, in fact, if desired the coil can be disposed above the lid with only sufficient gap provided between the lid portions to prevent current flow thereacross.

It should be understood that preferred embodiments have been described by way of illustrating the invention but that this invention includes various modifications and equivalents of the disclosed embodiments. The invention includes all modifications and equivalents of the disclosed embodiments falling within the scope of the appended claims.

I claim:

1. A thermally responsive electrical circuit protector comprising an electrically and thermally conductive housing having a bottom wall and upstanding side walls with an open top, the side walls having free ends formed into a ledge portion, a lid disposed on the ledge portion with an electrically insulative gasket interposed therebetween to electrically separate the housing from the lid, means to clampingly attach the lid to the housing, heat responsive electrical switch means disposed in the housing adapted to electrically connect and disconnect the housing and the lid upon the occurrence of selected thermal conditions characterized in that the lid comprises first and second spaced, discrete portions, the first portion mounts a portion of the switch means and the second portion is formed with an elongated portion extending beyond housing to serve as a terminal and a heater element is provided having two opposite ends, one end electrically and mechanically connected to the first portion and the other end electrically and mechanically connected to the second portion.

2. A thermally responsive electrical circuit protector according to claim 1 further characterized in that the heater element is configured as a coil of selected electrically resistive material.

3. A thermally responsive electrical circuit protector according to claim 2 further characterized in that the housing has a longitudinal axis with the first and second discrete portions of the lid spaced along the axis and the coil has a longitudinal axis which is parallel to the longitudinal axis of the housing.

4. A thermally responsive electrical circuit protector according to claim 2 further characterized in that the housing has a longitudinal axis with the first and second discrete portions of the lid spaced along the axis and the coil has a longitudinal axis which is generally perpendicular to the longitudinal axis of the housing.

5. A thermally responsive electrical circuit protector according to claim 1 further characterized in that the lid portions have two opposed surfaces including an internal surface facing a cavity within the housing and an external surface facing away from the housing, and the ends of the heater element are welded to respective portions of the lid on the internal surface thereof.

6. A thermally responsive electrical circuit protector according to claim 1 further characterized in that the lid portions have two opposed surfaces including an internal surface facing a cavity within the housing and an external surface facing away from the housing, and the ends of the heater element are welded to respective portions of the lid on the external surface thereof.

7. A thermally responsive electrical circuit protector according to claim 1 in which the first and second portions of the lid are formed of cold rolled steel and the heater element is formed of a nickel alloy.

8. A thermally responsive protector according to claim 1 further including means to provide environmental protection for the protector comprising a housing of electrically insulative material, the housing formed with a cavity adapted to receive the thermally responsive protector, the protector received in the cavity with the open end of the protector covered by the housing, the housing formed with electrical sockets connectable to the terminals of the protector, the sockets adapted to be pressed onto pins of a connector of an electrical device to be protected.

* * * * *